US007464924B2

(12) United States Patent
Morimoto et al.

(10) Patent No.: US 7,464,924 B2
(45) Date of Patent: Dec. 16, 2008

(54) SHEET FEEDER DEVICE AND IMAGE FORMING APPARATUS

(75) Inventors: Yasumasa Morimoto, Kashihara (JP); Yoshiyuki Nishizato, Nara (JP); Masato Tamehira, Nara (JP); Syoutaro Okamoto, Nara (JP); Yoshiyuki Nagai, Yamatokoriyama (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 517 days.

(21) Appl. No.: 10/874,368

(22) Filed: Jun. 24, 2004

(65) Prior Publication Data

US 2005/0023745 A1 Feb. 3, 2005

(30) Foreign Application Priority Data

Jun. 27, 2003 (JP) ..... P2003-185124

(51) Int. Cl.
*B65H 3/06* (2006.01)

(52) U.S. Cl. ..... 271/118; 271/117

(58) Field of Classification Search ..... 271/118, 271/116, 114, 117, 121
See application file for complete search history.

(56) References Cited

U.S. PATENT DOCUMENTS 4,822,023 A * 4/1989 Miyoshi ..... 271/118
5,435,537 A * 7/1995 Gysling ..... 271/10.05
5,842,694 A * 12/1998 Brooks et al. ..... 271/38
6,554,270 B2 * 4/2003 Yamamoto ..... 271/117

FOREIGN PATENT DOCUMENTS

JP 02-231320 A 9/1990
JP 2001-220026 * 1/2001
JP 2001-146329 A 5/2001

* cited by examiner

*Primary Examiner*—Kaitlin S Joerger
(74) *Attorney, Agent, or Firm*—Birch, Stewart, Kolasch & Birch, LLP

(57) ABSTRACT

A sheet feeder device is provided with a pick-up roller driving section which is operative to position the pick-up roller into a retracted position spaced a predetermined distance apart from a stack of document sheets on a document tray before and after the operation for feeding the series of document sheets, into a sheet feed position in which the pick-up roller abuts against the stack of document sheets for feeding the document sheets at an occasion of feeding of each of the document sheets in the operation for feeding the series of document sheets, and into the standby position above and close to the height of a stack of a maximum load number of document sheets carried on the document tray during a period from a point in time just after feeding of one sheet to a point in time just before feeding of a succeeding sheet.

10 Claims, 3 Drawing Sheets

SHEET FEEDER DEVICE AND IMAGE FORMING APPARATUS

CROSS REFERENCE

This nonprovisional application claims priority under 35 U.S.C. §119(a) on Patent Application No. 2003-185124 filed in Japan on Jun. 27, 2003, the entire contents of which are hereby incorporated by reference.

BACKGROUND OF THE INVENTION

The present invention relates to a sheet feeder device provided in an image forming apparatus such as a printer, facsimile apparatus or copying machine for feeding such sheets as document sheets or recording sheets to the image forming apparatus. The present invention also relates to an image forming apparatus provided with such a sheet feeder device.

In an image forming apparatus such as a copying machine or a printer, a given sheet feeder device feeds such sheets as document sheets or recording sheets from a sheet tray such as a document tray or a paper feed tray toward the image forming section.

Such a sheet feeder device picks up sheets one by one by rotating a given pick-up roller pressed against the uppermost surface of a stack of sheets placed on a sheet tray. In order to prevent plural sheets from being fed at a time the sheet feeder device passes sheets thus picked up between a given pair of separating roller and separating pad (friction pad) to feed the sheets one by one separately. In feeding a series of sheets successively, it is required that the feeding of a succeeding sheet fail to start during the feeding of the preceding sheet. For this purpose, the pick-up roller of the sheet feeder device is supported on a pivotable arm portion so as to be capable of pivoting toward and away from the sheet stack. The pick-up roller is positioned so as to be capable of separating away from the sheet stack to assume a predetermined retracted position after the separating roller has taken over the transport of one sheet. By thus causing the pick-up roller to reciprocate between the sheet feed position and the retracted position, sheets can be fed as spaced one from another.

With the increase in the sheet load that can be carried by a sheet tray (sheet carrying section) of an image forming apparatus in recent years, the spacing between adjacent sheets under feeding exerts increasing influence upon the processing speed of the image forming apparatus.

Under such circumstances, Japanese Patent Laid-Open Publication No. HEI 02-231320, for example, has proposed the art of reducing the spacing between adjacent document sheets by making higher the sheet transport speed for a feed path up to an idle roller which temporarily stops each document sheet to register the leading position thereof than the document reading speed.

However, the prior art described in this patent publication involves a problem that the increased document sheet transport speed is likely to cause document sheets to be fed askew or to make thin document sheets become wrinkled. In addition, when the feed path is curved, the increased transport speed is likely to cause a paper jam to occur.

If the time required for the pick-up roller to move between the retracted position and the sheet feed position in which the pick-up roller abuts against a stack of sheets to feed each sheet is shortened, the spacing between adjacent sheets can be reduced without increasing the sheet transport speed and, hence, the above-described problem will not occur.

SUMMARY OF THE INVENTION

A feature of the present invention is to provide a sheet feeder device capable of feeding sheets with reduced spacing between adjacent sheets without increasing the sheet transport speed. Another feature of the present invention is to provide an image forming apparatus provided with the sheet feeder device.

According to an embodiment of the present invention, a sheet feeder device comprises: a pick-up roller capable of abutting against and separating away from a sheet carried on a predetermined sheet carrying section, the pick-up roller being operative to feed the sheet when abutting against the sheet; and a pick-up roller driving section operative to position the pick-up roller into each of at least three stepwise positions including a retracted position spaced a predetermined distance apart from the sheet, a sheet feed position in which the pick-up roller abuts against the sheet, and a standby position intermediate the retracted position and the sheet feed position.

The pick-up roller driving section is capable of positioning the pick-up roller into the retracted position before and after an operation for feeding a series of sheets, into the sheet feed position at an occasion of feeding of each of the sheets in the operation for feeding the series of sheets, and into the standby position during a period from a point in time just after feeding of one sheet to a point in time just before feeding of a succeeding sheet in the operation for feeding the series of sheets.

This arrangement can make smaller the range of motion of the feed means in the operation for feeding a series of sheets than in the prior art, thereby reducing the spacing between adjacent sheets under feeding.

It is possible that the standby position is a position close to an uppermost surface of a stack of a maximum load number of sheets carried on the sheet carrying section. This position of the pick-up roller is a position closest to the sheet feed position, that is, a position spaced the shortest distance apart from the sheet feed position, within the positioning range where the pick-up roller can be fixed without contacting the stack of sheets irrespective of the number of sheets carried by the sheet carrying section. Among arrangements where the standby position can be fixed, the above-described arrangement can minimize the spacing between adjacent sheets under feeding.

The pick-up roller driving section may comprise: an arm member supporting the pick-up roller for pivoting to each of the three stepwise positions; a separating roller operative to transport sheets fed from the pick-up roller while separating the sheets one from another, the separating roller being a rotatable roller which has a rotating shaft pivotally supporting the arm member and is configured to be driven for rotation by a predetermined driving source; and a rotary power transmission section operative to transmit rotary power of the separating roller to the pick-up roller for rotating the pick-up roller.

The sheet feeder device may further comprise: a clutch operative to turn on/off the transmission of the rotary power by the rotary power transmission section; and bias means biasing the pick-up roller upwardly, wherein when the clutch is disengaged, the gravity of the pick-up roller and the biasing force of the bias means become balanced with each other to position the pick-up roller into the standby position.

This arrangement can realize the positioning of the pick-up roller into the standby position intermediate the sheet feed position and the retracted position by the provision of simple bias means such as an elastic member or a weight. Thus, there is no need to provide any one of such devices as a sensor for positioning the pick-up roller into the standby position, signal lines associated therewith, and signal processing means.

The foregoing and other objects, features and attendant advantages of the present invention will become apparent from the following detailed description of the preferred embodiments to be read with reference to the accompanying drawings.

DETAILED DESCRIPTION OF THE INVENTION

Hereinafter, embodiments of the present invention will be described in detail with reference to the drawings. It should be noted that these embodiments are only illustrative of the present invention and hence should not be construed to limit the technical scope of the present invention.

Figure 1:
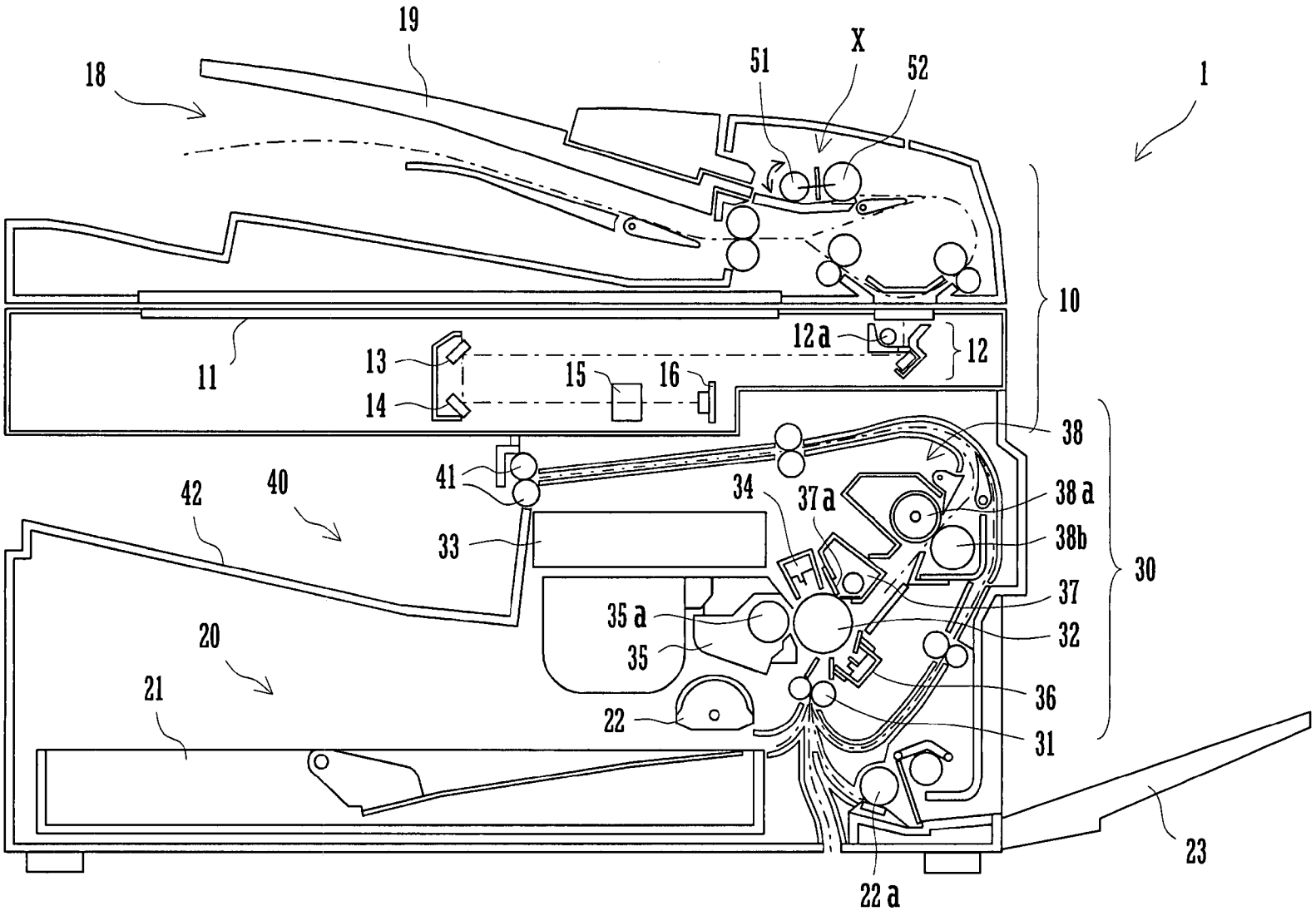
FIG. 1 is a sectional side elevational view schematically showing the construction of an image forming apparatus provided with a document feeder device X according to an embodiment of the present invention.
Figure 2:
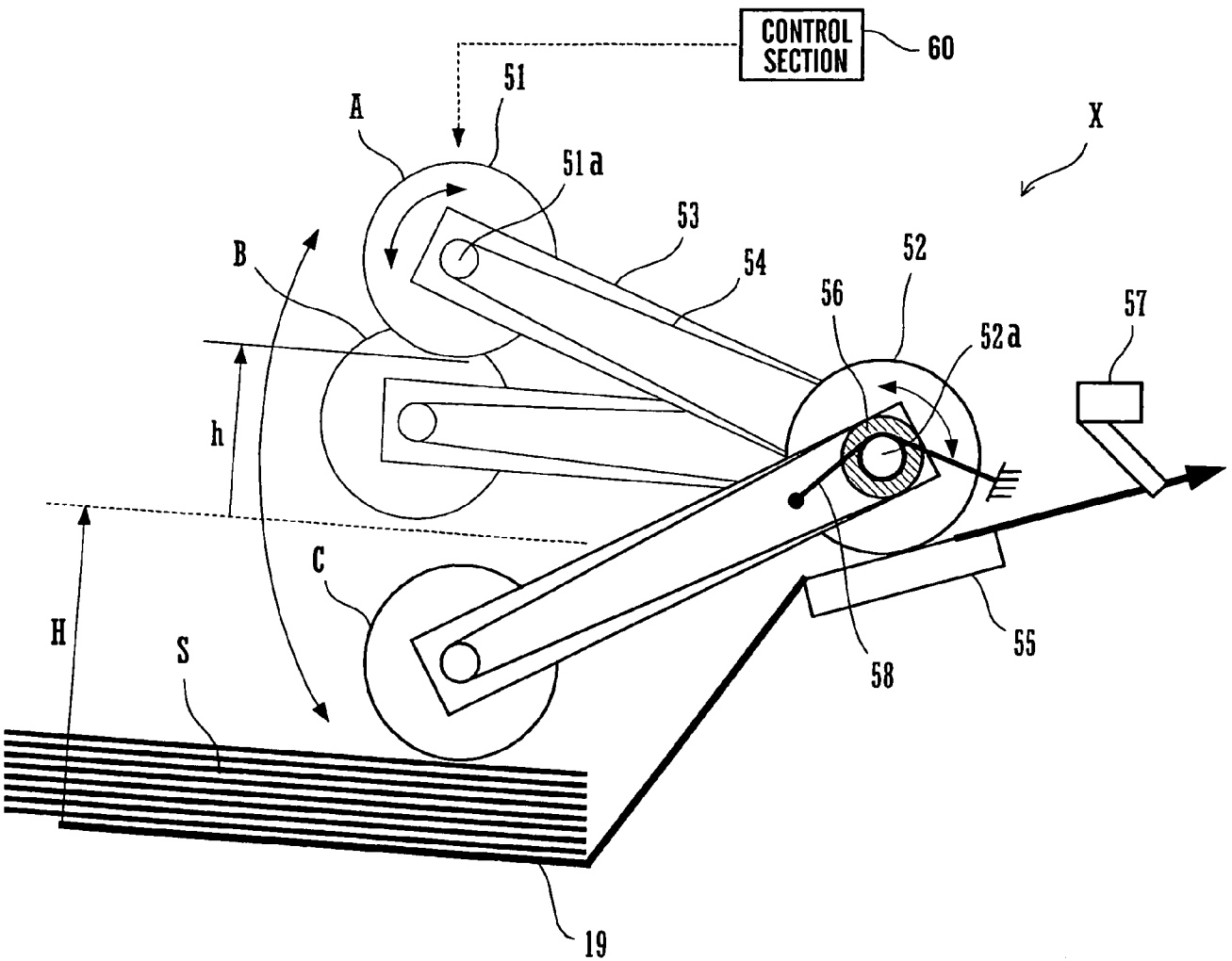
FIG. 2 is a schematic side elevational view of the document feeder device X according the embodiment of the present invention.
Figure 3:
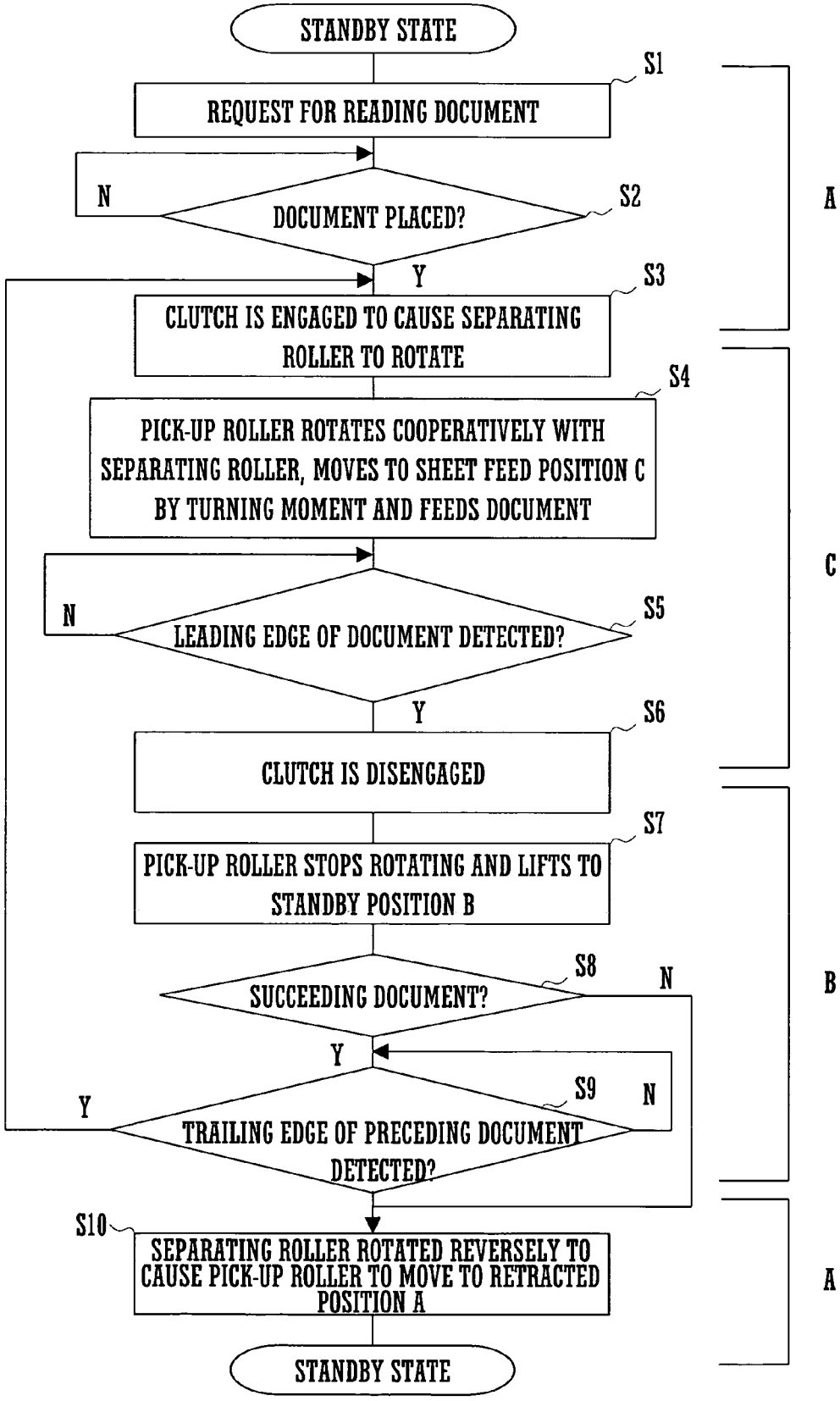
FIG. 3 is a flowchart of the procedural steps performed by the document feeder device X.

FIG. 1 is a sectional side elevational view schematically showing the construction of an image forming apparatus provided with a document feeder device X according to an embodiment of the present invention; FIG. 2 is a schematic side elevational view of the document feeder device X according the embodiment of the present invention; and FIG. 3 is a flowchart of the procedural steps performed by the document feeder device X.

Image forming apparatus 1 provided with document feeder device X according to an embodiment of the present invention will be described with reference to the sectional side elevational view at FIG. 1.

The image forming apparatus 1 has printing modes including a copier mode (copying mode), a printer mode and a FAX mode, any appropriate one of which is selected by a non-illustrated control section in response to an input made by manipulation through a non-illustrated manipulating section or a receipt of a printing job transmitted from an external host device such as a personal computer. As shown in FIG. 1, the image forming apparatus 1 generally includes a document reading section 10, a sheet feed section 20, a printing section 30, and a sheet ejecting section 40. The document reading section 10 is disposed above the sheet feed section 20, while the sheet ejecting section 40 is disposed intermediate the document reading section 10 and the sheet feed section 20.

Among the aforementioned processing modes, the copier mode will be described below.

First, the user places a document on platen glass 11 of the document reading section 10 and puts one or more sheets in a sheet feed cassette 21 of the sheet feed section 20 or on a manual feed tray 23 flanking the apparatus. When a start key on a control panel (not shown) disposed on a front-side portion of an apparatus cabinet is manipulated after inputting of data about the number of copies to be printed, printing magnification and the like through a condition input key on the control panel, a copying operation is started.

In response to the manipulation of the start key, a main drive motor (not shown) is actuated to cause associated drive gears to rotate. Subsequently, a roller 22 or a roller 22*a* rotates to feed one recording sheet into the apparatus and the sheet thus fed reaches a register roller 31, which in turn stops the sheet temporarily to synchronize the leading edge of the sheet to the leading end portion (image formation starting portion) of an image to be formed on a photosensitive drum 32. The leading edge of the recording sheet is evenly pressed against the register roller 31, so that the leading position of the sheet is corrected.

In the document reading section 10, on the other hand, a copy lamp 12*a* is turned on and a copy lamp unit 12 starts exposing the document to light while moving in the direction indicated by arrow. Light from the copy lamp 12*a* illuminating the document is turned into reflected light containing image information on the document. The reflected light is inputted to CCD 16 via a first mirror 12*b* of the copy lamp unit 12, second and third mirrors 13 and 14 and an optical lens 15, so that the image information contained therein is read.

The image information thus read, which is optical information, is converted into electric signals by a CCD circuit included in the non-illustrated control section. The image information signals are subjected to image processing under established conditions and then transmitted as print data to an LSU unit 33.

An electrostatic charger unit 34 charges a photosensitive drum 32 to a predetermined potential entirely. Laser light from the LSU unit 33 is applied to the photosensitive drum 32 via a non-illustrated polygonal mirror and various lenses to form an electrostatic latent image thereon. Thereafter, toner on an MG roller 35*a* in a developer tank 35 is attracted onto the surface of the photosensitive drum 32 and makes the electrostatic latent image tangible in accordance with a potential gap formed on the photosensitive drum 32.

The recording sheet to be formed with the image is transported toward the photosensitive drum 32 by the register roller 31 in a timed manner. Subsequently, a transfer unit 36 transfers the toner on the photosensitive drum 32 to the recording sheet. Residual toner on the photosensitive drum 32 is shaved away with a cleaning blade 37*a* of a drum unit and then recovered by a cleaner unit 37.

The recording sheet bearing the transferred toner is passed between upper and lower heat rollers 38*a* and 38*b* of a fixing unit 38 so as to be applied with heat and pressure, with the result that the unfixed toner on the sheet is fused and fixed to the sheet. Finally, the sheet is ejected into an ejected sheet tray 42 by ejecting rollers 41.

In the case where a predetermined sensor detects the fact that one or more document sheets (hereinafter will be generally referred to as "document" as the case may be) are placed on a document tray 19 of the document feeder device X included in the document reading section 10, the document sheets are automatically fed sequentially from the first one by the document feeder device X for the copying operation to be performed thereon.

Specifically, when the start key is manipulated, a pick-up roller 51 of the document feeder device X rotates to feed the document sheets placed on the document tray 19 into the document reading section 10 sequentially from the first one and transported along a predetermined feed path. On the other hand, the copy lamp unit 12 exposes the document sheets under feeding to light while remaining stationary at a predetermined stop position. The images of the document sheets are read from reflected light resulting from the exposure of the document sheets.

The document sheets of which the images have been thus read are ejected into a document delivery section 18.

Description will be made of the document feeder device X according to this embodiment with reference to the side view at FIG. 2.

The document feeder device X includes the pick-up roller 51, a separating roller 52, a friction pad (separating pad) 55 which is a high-friction member confronting the separating roller 52, a non-illustrated driving source for driving the separating roller 52, and control section 60 which incorporates a CPU and a storage device, such as ROM, storing a predetermined program to be executed by the CPU and which is operative to control the driving source and the like so as to control the respective operations of the pick-up roller 51 and the separating roller 52.

The pick-up roller 51 rotates as abutting against document S to feed the document S. The aforementioned pick-up roller driving section includes: an arm member 53 pivotally supporting the pick-up roller 51; the separating roller 52 operative to transport document sheets S fed from the pick-up roller 51 into the image forming apparatus 1 while separating the document sheets S one from another, the separating roller 52 being a rotatable roller which has a rotating shaft 52*a* pivotally supporting the arm member 53 and is configured to be driven for rotation by the aforementioned driving source; and an endless belt 54 as an example of the rotary power transmission section which is operative to transmit the rotary power of the separating roller 52 to the pick-up roller 51 for rotating the pick-up roller 52. The pick-up roller 51 moves toward and away from the document on the document tray 19 by the pivotal movement of the arm member 53.

The arm member 53 is supported at the rotating shaft 52*a* of the separating roller 52 via a non-illustrated one-way clutch. This one-way clutch causes the arm member 53 to engage the rotating shaft 52*a* when the rotating shaft 52*a* rotates in the opposite direction (clockwise direction in the figure) to the sheet (document sheet) feeding direction, whereas the one-way clutch disengages the arm member 53 from the rotating shaft 52*a* when the rotating shaft 52 rotates in reverse (counterclockwise direction in the figure). A clutch 56 is disposed intermediate the endless belt 54 and the rotating shaft 52 of the separating roller 52. Transmission of the rotary power of the separating roller 52 to the pick-up roller 51 can be turned on/off by engaging/disengaging the clutch 56.

The friction pad 55 is disposed as closely facing the separating roller 52 on the lower side of the separating roller 52. Even when plural document sheets S are fed as superposed on each other by the pick-up roller 51, the document sheets S are separated one from another as they pass between the separating roller 52 and the friction pad 55 because there is a difference in frictional resistance between the upper side and the lower side of the document sheets S.

A sheet passage sensor 57 located downstream of the separating roller 52 detects whether or not each document sheet S is passing the portion of concern.

A bias member 58, such as a helical spring, biases the arm member 53 in such a direction as to lift the arm member 53. Instead of the bias member 58, other type of bias member such as an appropriate weight may be used to bias the arm member 53 upward.

The pick-up roller 51 is configured to pivot (move) to assume each of the three positions: retracted position A, standby position B and sheet feed position C shown in FIG. 2 under control by the control section 60.

Here, the retracted position A is a position in which the pick-up roller 51 is upwardly spaced a predetermined height h of allowance apart from the height of a stack of a maximum load number of document sheets S on the document tray 19 (indicated by broken line H, hereinafter will be referred to as "maximum load height H".) The pick-up roller 51 assumes the retracted position A when document (sheet) feeding is not performed, for example, when the image forming apparatus 1 is out of action. Thus, the retracted position A is a home position. The height h of allowance is a height defining a sufficient space for the pick-up roller 51 to keep out of the way of a stack of the maximum load number of document sheets S being set on the document tray 19. With increasing height h of allowance, the document feed timing is delayed increasingly, which may result in a trouble in document feeding. If the height h is too small, it is likely that document sheets S are fed as superposed or overlapped one upon another. For this reason, the height h of allowance cannot be determined unconditionally. However, height h of about several millimeters (3-7 mm for example) is considered to be suitable when the spacing between adjacent document sheets S under feeding (the spacing between the trailing edge of one document sheet and the leading edge of the succeeding document sheet) is taken into consideration.

The standby position B is a position in which the pick-up roller 51 is located above and closely to the maximum load height H (i.e., closely to the uppermost surface of a stack of the maximum load number of document sheets on the document tray 19.) The pick-up roller 51 assumes the standby position B during a period from a point in time just after feeding of one sheet to a point in time just before feeding of a succeeding sheet in the operation of feeding a series of document sheets S placed on the document tray 19 (hereinafter will be referred to as "successive sheet feeding operation"), which is performed in response to a predetermined operation for starting document reading.

The sheet feed position C is a position in which the pick-up roller 51 abuts against the uppermost surface of a stack of document sheets S to feed the document sheets S. The pick-up roller 51 assumes the sheet feed position C at an occasion of feeding of each document sheet S in the successive sheet feeding operation.

When the rotating shaft 52*a* of the separating roller 52 is caused to rotate in the opposite direction (clockwise direction in the figure) to the document sheet feeding direction (hereinafter will be referred to as "reverse rotation"), engagement by the one-way clutch causes the arm member 53 to follow the reverse rotation of the rotating shaft 52*a*, thereby achieving the positioning of the pick-up roller 51 into the retracted position A (that is, causing the pick-up roller 51 to move from the sheet feed position C to the retracted position A.) When the rotating shaft 52*a* of the separating roller 52 is caused to rotate in the document sheet feeding direction (counterclockwise direction in the figure) (hereinafter will be referred to as "forward rotation"), turning moment (in the direction of forward rotation) is produced on the rotating shaft 51*a* of the pick-up roller 51 relative to the rotating shaft 52*a* of the separating roller 52, so that the pick-up roller 51 is caused to move from the retracted position A to the sheet feed position C (by pivoting of the arm member 53), whereby the positioning of the pick-up roller 51 into the sheet feed position C is achieved. At that time, the arm member 53 pivots to the sheet feed position C against the biasing force of the bias member 58 by the turning moment. Further, the turning moment acts as a biasing force pressing the pick-up roller 51 against the document S, so that friction occurs between the pick-up roller 51 and the surface of the document S, thus enabling the feeding of the document S. At that time, the clutch 56 is in the engaged condition.

When the clutch 56 is disengaged (coupling is released), the biasing force of the bias member 58 causes the pick-up roller 51 to assume the standby position B. Specifically, adjustment is previously made so that the gravity of the pick-up roller 51 and the biasing force of the bias member 58 become balanced with each other when the pick-up roller 51 is in the standby position B.

This arrangement can realize the positioning of the pick-up roller 51 into the standby position B intermediate the sheet feed position C and the retracted position A by the provision of the simple bias member 58. Thus, there is no need to provide any one of such devices as a sensor for positioning the pick-up roller 51 into the standby position B, signal lines associated therewith, and signal processing means.

The procedure for positioning the pick-up roller 51 by the control section 60 will be described with reference to the flowchart at FIG. 3. In the following description, procedural steps are indicated at S1, S2, . . . , sequentially. In the initial state the pick-up roller 51 is in the retracted position A.

Initially, when a document reading request signal is inputted to the control section 60 from the control panel through a predetermined manipulation for starting document reading (S1), the control section 60 checks whether or not document S is placed on the document tray 19 (S2). This checking is made by judgment based on the result of detection by a non-illustrated document sensor. If it is judged that document S is not placed on the document tray 19, a predetermined message is displayed on a display section (not shown) to prompt for placement of document S.

On the other hand, if it is judged that document S is placed on the document tray 19, the control section 60 causes the clutch 56 to be engaged, thereby causing the rotating shaft 52*a* of the separating roller 52 to rotate forwardly (S3).

As a result, the endless belt 54 rotates forwardly to cause the pick-up roller 51 to rotate forwardly. At the same time, turning moment in the direction of forward rotation is produced on the rotating shaft 51*a* of the pick-up roller 51 relative to the rotating shaft 52*a* of the separating roller 52, so that the arm member 53 is caused to pivot to the sheet feed position C. Thus, the pick-up roller 51 is positioned to abut against the document S thereby starting sheet feeding (S4). The operation performed at S4 is a mechanically linked operation caused in response to the operation at S3.

Subsequently, the control section 60 monitors the sheet passage sensor 57 and waits until the leading edge of the document sheet S that starts being fed reaches the sheet passage sensor 57. When the reaching of the document sheet S is detected (that is, the state of the sensor 57 changes from OFF to ON), the control section 60 disengages the clutch 56 (S6).

As a result, the pick-up roller 51 springs up (lifts) by the biasing force of the bias member 58 to assume the standby position B at which the gravity of the pick-up roller 51 and the biasing force of the bias member 58 become balanced with each other (S7). The operation performed at S7 is a mechanically linked operation caused in response to the operation at S6.

At the time the leading edge of the document sheet S reaches the sheet passage sensor 57, the separating roller 52 has already started transport of the document sheet S. Hence, the separating roller 52 takes over the transport (feeding) of the document sheet S from the pick-up roller 51 by the operation at S6. Subsequently, as in the operation at S7, the control section 60 checks the document sensor to judge whether or not the succeeding document sheet S remains on the document tray 19 (S8). If it is judged that the succeeding document sheet S remains on the document tray 19, the control section 60 monitors the sheet passage sensor 57 again and waits until the trailing edge of the document sheet S passes by the sheet passage sensor 57 (S9).

When the sheet passage sensor 57 detects the trailing edge of the document sheet S passing by the sensor 57 (that is, the state of the sensor 57 changes from ON to OFF), the process returns to S3 to repeat the above-described operations. By so doing, the plural document sheets S on the document tray 19 are successively fed into the image forming apparatus 1 until the document S on the document tray 19 runs out.

On the other hand, if it is judged that no document S remains on the document tray 19 at step S8, the control section 60 controls the driving source so that the rotating shaft 52*a* of the separating roller 52 rotates in reverse to cause the arm member 53 to abut against a predetermined stop (not shown), thereby positioning the pick-up roller 51 into the retracted position A (S10). In this way the feeding of a series of document sheets S is completed.

According to the process shown in FIG. 3, the pick-up roller 51 is positioned into the retracted position A before and after feeding of a series of document sheets S (S1, S2 and S10), into the sheet feed position A at an occasion of feeding of each of the document sheets S (S3 to S5) in the feeding of the series of document sheets S, and into the standby position B during a period from a point in time just after feeding of one document sheet S to a point in time just before feeding of a succeeding document sheet S (S6 to S9) in the feeding of the series of document sheets S.

Thus, the pick-up roller 51 moves (reciprocates) within a smaller range of motion in the feeding of a series of document sheets S than in the conventional document feeding in which the pick-up roller 51 reciprocates between the sheet feed position C and the retracted position A for feeding of each document sheet S. Therefore, the time required for the pick-up roller 51 to move is shortened and, hence, the spacing between adjacent document sheets C under feeding can be reduced. As a result, the sheet feeder device can contribute to an improvement in the processing speed of the image forming apparatus while preventing feeding troubles such as feeding of a document sheet S on the skew.

While the foregoing embodiment is directed to the art of document feeding, the present invention is not limited thereto. For example, the present invention may be applied to other type of sheet feeding such as feeding of recording sheets placed on the manual feed tray 23.

In the foregoing embodiment, the standby position B is established at a location above and close to the height of a stack of a maximum load number of document sheets S on the document tray in order to realize a simple arrangement having no means for detecting the position of the pick-up roller 51.

However, alternative arrangements are conceivable, including, for example, an arrangement wherein: means for detecting the position of the pick-up roller 51 (rotary-type potentiometer or the like) is provided; the standby position B is established at a location slightly higher than the sheet feed position C detected by the position detecting means; and the pick-up roller 51 is raised to the standby position B by reverse rotation of the separating roller 52.

This arrangement makes it possible to keep constant and minimum the spacing between adjacent document sheets S under feeding.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A sheet feeder device comprising:

a pick-up roller capable of abutting against and separating away from a sheet carried on a predetermined sheet carrying section, the pick-up roller being operative to feed the sheet when abutting against the sheet;

a pick-up roller driving section operative to position the pick-up roller into each of at least three stepwise positions including a retracted position spaced a predetermined distance apart from the sheet, a sheet feed position in which the pick-up roller abuts against the sheet, and a standby position intermediate the retracted position and the sheet feed position: and a control section for controlling positioning of the pick-up roller by the pick-up roller driving section, wherein the predetermined distance is a distance defining a sufficient space in which the pick-up roller is upwardly spaced a predetermined height h of allowance apart from a height H of a stack of a maximum number of sheets loaded on the predetermined sheet carrying section, and during an operation for feeding a series of sheets, the control section controls the pick-up roller to first be in the sheet feed position in which the pick-up roller abuts against the stack of sheets loaded on the predetermined sheet carrying section, then, after feeding a sheet from the stack of sheets, to be in the standby position during a period from a point in time just after feeding of said sheet to a point in time just before feeding of a succeeding sheet of the series of sheets, after which time the pick-up roller is sequentially controlled to be in the sheet feed position to feed the next sheet in the series of sheets and then to be in the standby position during the period from the point in time just after feeding of the next sheet in the series of sheets to a point in time just before feeding of the next succeeding sheet of the series of sheets, until all sheets in the series of sheets have been fed.

2. The sheet feeder device according to claim 1, wherein the pick-up roller driving section is operative to position the pick-up roller into the retracted position before and after the operation for feeding a series of sheets, and into the sheet feed position at an occasion of feeding of each of the sheets in the operation for feeding the series of sheets.

3. The sheet feeder device according to claim 2, wherein the standby position is a position close to an uppermost surface of a stack of a maximum load number of sheets carried on the sheet carrying section.

4. The sheet feeder device according to claim 2, wherein the pick-up roller driving section comprises:

an arm member supporting the pick-up roller for pivoting to each of the three stepwise positions;

a separating roller operative to transport sheets fed from the pick-up roller while separating the sheets one from another, the separating roller being a rotatable roller which has a rotating shaft pivotally supporting the arm member and is configured to be driven for rotation by a predetermined driving source; and a rotary power transmission section operative to transmit rotary power of the separating roller to the pick-up roller for rotating the pick-up roller.

5. The sheet feeder device according to claim 4, further comprising:

a clutch operative to turn on/off the transmission of the rotary power by the rotary power transmission section; and bias means biasing the pick-up roller upwardly, wherein when the clutch is disengaged, the gravity of the pick-up roller and the biasing force of the bias means become balanced wit each other to position the pick-up roller into the standby position.

6. An image forming apparatus comprising:

an image forming section operative to form an image on a photosensitive member based on image data;

a sheet carrying section for carrying thereon a sheet to which the image is to be transferred in the image forming section;

a pick-up roller capable of abutting against and separating away from a sheet carried on the sheet carrying section, the pick-up roller being operative to feed the sheet when abutting against the sheet;

a pick-up roller driving section operative to position the pick-up roller into each of at least three stepwise positions: a retracted position spaced a predetermined distance apart from the sheet, a sheet feed position in which the pick-up roller abuts against the sheet, and a standby position intermediate the retracted position and the sheet feed position: and a control section for controlling positioning of the pick-up roller by the pick-up roller driving section, wherein during an operation for feeding a series of sheets, the control section controls the pick-up roller to first be in the sheet feed position in which the pick-up roller abuts against a stack of sheets loaded on sheet carrying section, then, after feeding a sheet from the stack of sheets, to be in the standby position during a period from a point in time just after feeding of said sheet to a point in time just before feeding of a succeeding sheet of the series of sheets, after which time the pick-up roller is sequentially controlled to be in the sheet feed position to feed the next sheet in the series of sheets and then to be in the standby position during the period from the point in time just after feeding of the next sheet in the series of sheets to a point in time just before feeding of the next succeeding sheet of the series of sheets, until all sheets in the series of sheets have been fed.

7. The image forming apparatus according to claim 6, wherein the pick-up roller driving section is operative to position the pick-up roller into the retracted position before and after an operation for feeding a series of sheets, and into the sheet feed position at an occasion of feeding of each of the sheets in the operation for feeding the series of sheets.

8. The image forming apparatus according to claim 7, wherein the standby position is a position close to an uppermost surface of a stack of a maximum load number of sheets carried on the sheet carrying section.

9. The image forming apparatus according to claim 7, wherein the pick-up roller driving section comprises:

an arm member supporting the pick-up roller for pivoting to each of the three stepwise positions;

a separating roller operative to transport sheets fed from the pick-up roller while separating the sheets one from another, the separating roller being a rotatable roller which has a rotating shaft pivotally supporting the arm member and is configured to be driven for rotation by a predetermined driving source; and a rotary power transmission section operative to transmit rotary power of the separating roller to the pick-up roller for rotating the pick-up roller.

10. The image forming apparatus according to claim 9, further comprising:

a clutch operative to turn on/off the transmission of the rotary power by the rotary power transmission section; and bias means biasing the pick-up roller upwardly, wherein when the clutch is disengaged, the gravity of the pick-up roller and the biasing force of the bias means become balanced with each other to position the pick-up roller into the standby position.

* * * * *